US010865012B2

(12) United States Patent
Smith et al.

(10) Patent No.: US 10,865,012 B2
(45) Date of Patent: Dec. 15, 2020

(54) PEAKED ROOFING PALLETS

(71) Applicants: Daniel W. Smith, Carmel, IN (US); Jeffrey Neagli, Indianapolis, IN (US)

(72) Inventors: Daniel W. Smith, Carmel, IN (US); Jeffrey Neagli, Indianapolis, IN (US)

( * ) Notice: Subject to any disclaimer, the term of this patent is extended or adjusted under 35 U.S.C. 154(b) by 0 days.

(21) Appl. No.: 16/248,455

(22) Filed: Jan. 15, 2019

(65) Prior Publication Data

US 2019/0217989 A1 Jul. 18, 2019

Related U.S. Application Data

(63) Continuation-in-part of application No. 15/873,485, filed on Jan. 17, 2018, now Pat. No. 10,550,588.

(60) Provisional application No. 62/781,136, filed on Dec. 18, 2018.

(51) Int. Cl.

| | |
|---|---|
| ***B65D 19/00*** | (2006.01) |
| ***E04G 21/14*** | (2006.01) |
| ***B65D 19/38*** | (2006.01) |
| ***E04G 21/16*** | (2006.01) |
| *E04G 3/26* | (2006.01) |

(52) U.S. Cl.

CPC ..... *B65D 19/004* (2013.01); *B65D 19/0018* (2013.01); *B65D 19/38* (2013.01); *E04G 21/14* (2013.01); *E04G 21/166* (2013.01); *B65D 2519/00029* (2013.01); *B65D 2519/00034* (2013.01); *B65D 2519/00064* (2013.01); *B65D 2519/00069* (2013.01); *B65D 2519/0094* (2013.01); *B65D 2519/00268* (2013.01); *B65D 2519/00273* (2013.01); *B65D 2519/00288* (2013.01); *B65D 2519/00318* (2013.01); *B65D 2519/00338* (2013.01); *B65D 2519/00786* (2013.01); *E04G 3/26* (2013.01)

(58) Field of Classification Search

CPC .. E04G 3/26; E04G 3/265; E04G 3/00; E04G 1/36; E04G 21/14; E04D 15/00; E04D 15/003; B65D 19/08; B65D 19/18; B65D 25/24; B65D 19/004

USPC ..... 108/57.25, 57.28, 42; 182/45; 248/237; 414/10; 220/628

See application file for complete search history.

(56) References Cited

U.S. PATENT DOCUMENTS

| | | | | |
|---|---|---|---|---|
| 403,636 | A * | 5/1889 | Bitterly | E06C 1/397 182/20 |
| 472,867 | A * | 4/1892 | Farland | E04G 3/26 248/237 |
| 673,065 | A * | 4/1901 | Scott | E06C 1/397 182/20 |
| 674,170 | A * | 5/1901 | Kuhn | E04G 3/26 248/237 |
| 829,312 | A * | 8/1906 | Alberty | E04G 3/26 248/237 |
| 956,406 | A * | 4/1910 | Nowodworski | E04G 3/26 182/45 |
| 980,618 | A * | 1/1911 | Douglas | E04G 3/26 182/45 |

(Continued)

*Primary Examiner* — Katherine W Mitchell
*Assistant Examiner* — Shiref M Mekhaeil

(57) ABSTRACT

A pallet that is configured and designed to support a load of material and rest alternatively on a flat surface on a roof so as to straddle the peak or ridge of a roof. The pallets can be loaded with materials such as roofing shingles, delivered to a work site on a truck bed and lifted up and positioned on the peak or ridge of a roof without having to unload the materials from the pallets.

15 Claims, 6 Drawing Sheets

(56) References Cited

U.S. PATENT DOCUMENTS 988,808 A * 4/1911 Parris ..... E04G 3/26 182/45
1,148,919 A * 8/1915 Nielsen ..... E04G 3/26 248/237
1,222,053 A * 4/1917 Watson ..... E04G 3/26 248/237
1,248,228 A * 11/1917 West ..... E06C 1/397 182/20
1,365,996 A * 1/1921 Herwick ..... E04G 3/26 182/45
1,770,097 A * 7/1930 Saxon ..... E04G 3/26 248/237
2,448,746 A * 9/1948 Sundeen ..... E04G 3/26 182/45
3,058,542 A * 10/1962 Rogalla ..... E06C 1/345 182/45
3,318,473 A * 5/1967 Jones ..... B65D 88/26 414/608
3,702,100 A * 11/1972 Wharton ..... B65D 19/0012 108/53.3
4,809,618 A * 3/1989 Bell ..... B65D 19/0018 108/57.28
4,838,176 A * 6/1989 Bowser, Sr. ..... B65D 19/0018 108/53.3
D307,969 S * 5/1990 Box ..... D3/312
5,154,286 A * 10/1992 Gits ..... B65D 19/0018 206/319
5,304,095 A * 4/1994 Morris ..... F24F 7/02 454/365
5,377,600 A * 1/1995 Speese ..... B65D 19/0016 108/51.3
5,623,788 A * 4/1997 Bimberg ..... E04B 7/02 52/23
5,960,904 A * 10/1999 Ullmann ..... E04G 3/26 182/45
6,234,087 B1 * 5/2001 Brown ..... B65D 19/0034 108/55.1
6,269,905 B1 * 8/2001 Smith ..... E04D 15/02 182/45
6,745,869 B2 * 6/2004 Garrett ..... B23D 45/003 182/45
7,874,451 B2 * 1/2011 Bel ..... E04D 15/00 220/628
8,016,079 B1 * 9/2011 Huls ..... B27B 21/00 182/152
2003/0029870 A1 * 2/2003 Apps ..... B65D 71/70 220/509
2005/0207873 A1 * 9/2005 Endrud ..... E04D 15/02 414/10
2005/0211139 A1 * 9/2005 Perrotta ..... B65D 19/0038 108/57.25
2005/0284830 A1 * 12/2005 Snyker ..... A47F 5/103 211/133.4
2008/0053342 A1 * 3/2008 Muirhead ..... B65D 19/0012 108/57.25
2008/0245280 A1 * 10/2008 Wainland ..... A47B 13/003 108/153.1
2009/0229213 A1 * 9/2009 Mistelski ..... A01M 31/02 52/650.3
2009/0249740 A1 * 10/2009 Crookston ..... E04D 15/02 52/749.12
2010/0213005 A1 * 8/2010 Sistonen ..... E04D 15/02 182/45
2013/0220403 A1 * 8/2013 Rizzo ..... F16B 7/0446 136/251
2014/0190976 A1 * 7/2014 Imbrecht ..... B65D 19/18 220/592.01
2014/0273793 A1 * 9/2014 Tippmann ..... B65D 19/38 454/232
2015/0001114 A1 * 1/2015 Kelly ..... B65D 19/00 206/386
2015/0021452 A1 * 1/2015 Bourbonnais ..... B65D 19/38 248/544
2015/0040803 A1 * 2/2015 Burk ..... B65D 19/0038 108/53.3
2016/0194110 A1 * 7/2016 Balazs ..... B65D 19/06 206/386
2017/0174391 A1 * 6/2017 Burk ..... B65D 19/0051
2017/0274232 A1 * 9/2017 Kreuser ..... A62C 3/0257
2017/0320656 A1 * 11/2017 Oskarsson ..... B65D 1/22
2018/0029766 A1 * 2/2018 Chung ..... B65D 81/057
2018/0029776 A1 * 2/2018 Chung ..... B65D 65/466
2018/0334814 A1 * 11/2018 Rashid ..... E04G 3/26
2019/0031393 A1 * 1/2019 El Kawam ..... B65D 19/0018
2019/0059583 A1 * 2/2019 Sullivan ..... A47F 5/0081
2019/0062124 A1 * 2/2019 Sedlock ..... B66C 1/16

* cited by examiner

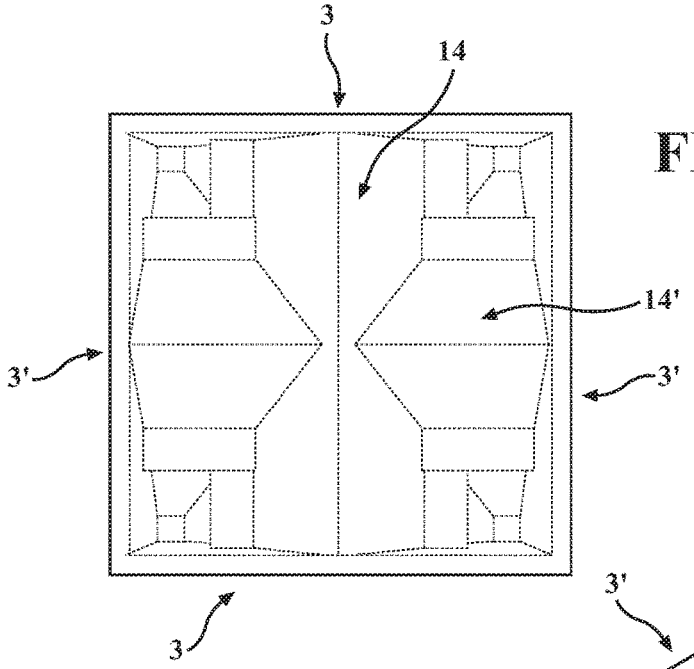
FIG. 7A
FIG. 7B
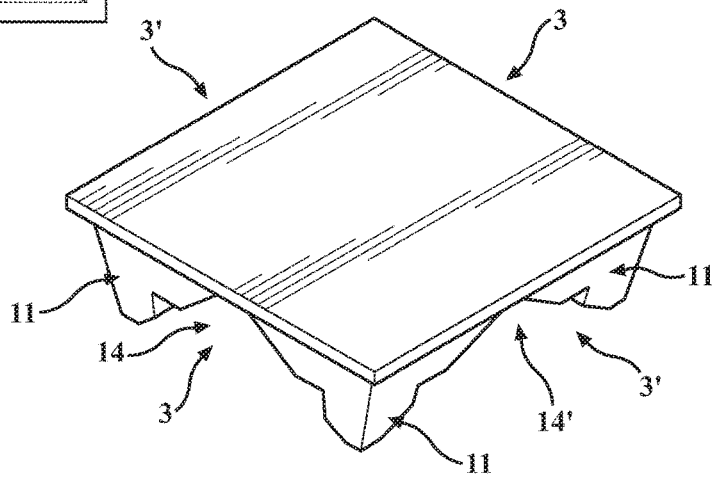
FIG. 7C
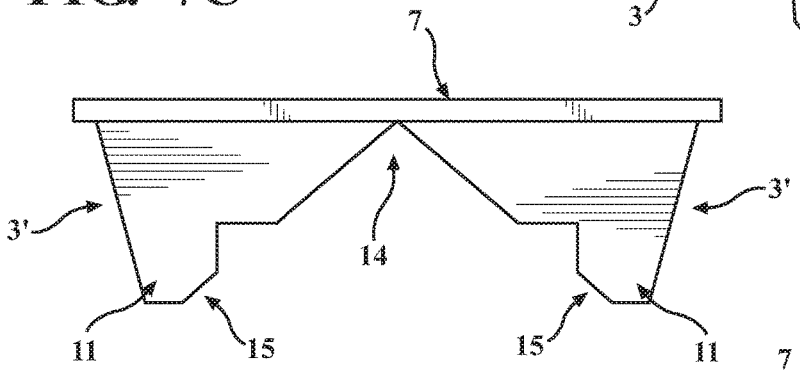
FIG. 7D
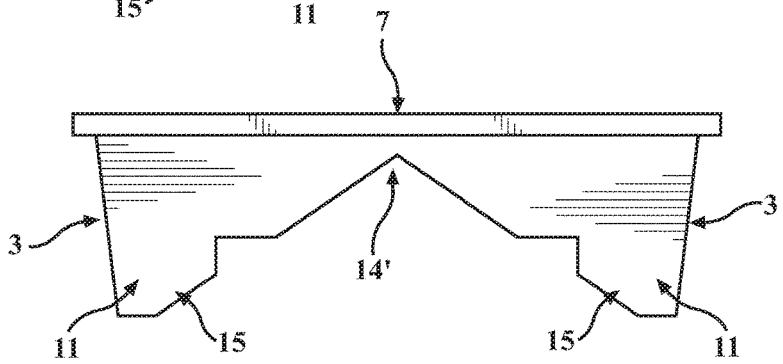

PEAKED ROOFING PALLETS

RELATED APPLICATIONS

The present application is a continuation-in-part of U.S. Non-provisional patent application Ser. No. 15/873,485, filed Jan. 17, 2018 that incorporates subject matter from U.S. Provisional Patent Application Ser. No. 62/781,136, filed Dec. 18, 2018. Priority of the present application is claimed under 35 U.S.C. § 120 to each of U.S. Non-provisional patent application Ser. No. 15/873,485 and Provisional Patent Application Ser. No. 62/781,136, and the entire disclosures of each application is hereby expressly incorporated by reference.

BACKGROUND

The present invention relates generally to roof construction and replacement and more particularly to specialized pallets for transporting and delivering roofing materials, including roofing shingles onto peaked roofs.

Roofing shingles are generally packaged in bundles that are stored and shipped on wooden pallets. Prior to the construction of new roofs or the replacement or reroofing of existing roofs roofing shingles need to be delivered onto the roofs. Pallets loaded with bundles of roofing shingles are transported by trucks from warehouses to the worksites and the individual shingle bundles are hauled up to the roofs by a conveyor or the pallets loaded with the shingle bundles are lifted up by a crane or fork lift. In the case of lifting pallets up to a roof by a crane or fork lift the individual bundles of shingles are unloaded from the pallets manually by workers and stacked on opposite sides of the roof ridge. The process of delivering shingles onto roofs is time consuming, labor intensive and exposes workers to unnecessary hazards.

U.S. Pat. No. 6,745,869 to Garrett, U.S. Patent Application Publication No. 2005/0207873 to Endrud, U.S. Patent Application Publication No. 20150021452 to Bourbonnais, United Kingdom Patent Application No. 2 365 845 to Wigley and German Patent Application No. DE3632735 to Bruenyjen exemplify various structures for supporting materials on roofs which involve complicated adjustable structures that require assembly and adjustment which can be inconvenient and hazardous for workers on roofs. In some cases these prior art devices merely provide platforms which can receive various objects including pallets.

U.S. Pat. No. 7,874,451 to Bel discloses a container for use on planar surfaces having various slopes. U.S. Patent Application Publication No. 2009/0044732 to MacKenzie discloses a pallet with a collapsible frame. U.S. Pat. No. 4,326,467 to Schleicher et al. discloses a pallet formed from a folded profiled metal sheet.

The present invention provides pallets that are designed and configured to straddle and rest on the ridge or peak of a roof which pallets can be used to store, transport and deliver roofing materials, including shingles onto roofs during construction or reroofing.

BRIEF SUMMARY

According to various features, characteristics and embodiments of the present invention which will become apparent as the description thereof proceeds, the present invention provides a pallet having a length and a width that is configured to rest alternatively on the peak of a roof and on a flat surface, the pallet comprising:

a top deck for receiving and supporting materials to be delivered to a rooftop;

a base beneath the top deck; and a plurality of legs extending downward from the base, wherein the legs have: angled bottom portions for that are angled so as to rest on opposite sides of the peak of a roof; and flat bottom portions for resting the pallet on a flat surface.

The present invention further provides a method of delivering objects onto the roof of a building which method comprises:

providing a pallet that comprises:

a top deck for receiving and supporting materials to be delivered to a rooftop;

a base beneath the top deck; and a plurality of legs extending downward from the base, wherein the legs have: angled bottom portions for that are angled so as to rest on opposite sides of the peak of a roof; and flat bottom portions for resting the pallet on a flat surface;

providing a load of objects on the pallet;

lifting the pallet and positioning the pallet onto a roof of a building so that the pallet rests over a peak of the roof to deliver the objects onto the roof.

BRIEF DESCRIPTION OF THE DRAWINGS

The present invention will be described with reference to the attached drawings which are given as non-limiting examples only, in which:

FIGS. 7*a*-7*d* depict views of a two-way pallet that includes inverted V-shaped recesses and angled surface pairs on opposite bottom sides that are configured to allow the pallet to rest on the peaks of roofs that have different slopes.

DETAILED DESCRIPTION OF THE DRAWINGS AND THE PRESENTLY PREFERRED EMBODIMENTS

The present invention provides pallets that are configured to receive materials, including roofing shingles, and support the materials on a flat surface or over the peak or ridge of a roof without the need for a separate conventional pallet. The pallets of the present invention are configured to be transported fully loaded on trucks to work sites and be lifted fully loaded and placed onto the peak of ridge of a roof using fork lifts, cranes, etc. without any necessary adjustments required to rest on the peak of a roof. The pallets are designed and configured to straddle the ridge or peak of a roof.

The pallets of the present invention can be manufactured as one-piece, molded structures that can be discarded after use or reused. In some embodiments that pallets can be molded from recyclable materials such as plastic materials for purposes of recycling of the materials. In other embodiments the pallets can be molded from materials such as particle board so that they can be discarded and burnt for disposal after use.

As described below the pallets of the present invention can be configured to be used in conjunction with roofs having different pitches. Further the pallets can be provided with structural elements to receive the forks of fork lifts, lifting straps, chains, etc. for purposes of lifting the pallets with a fork lift, a crane, a pulley system, etc.

The pallets of the present invention can be sized to support and deliver a typical amount of 42 bundles of shingles in which there are 3 bundles per square (100 square feet). The pallets can otherwise be sized to support and deliver a larger or smaller amount of shingles.

Figure 1:
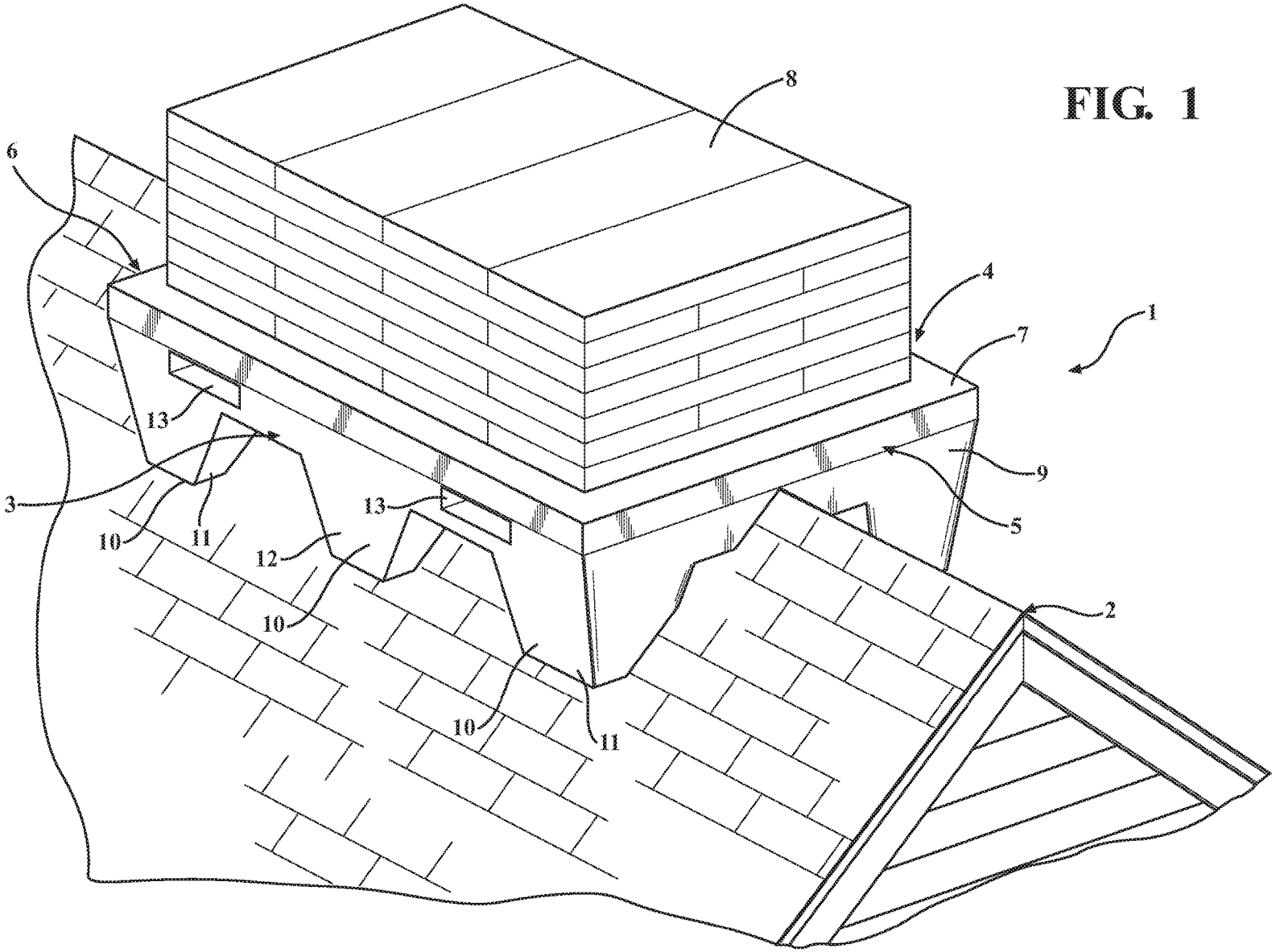
FIG. 1 a perspective view of a pallet according to the present invention positioned on the peak or a roof.

FIG. 1 a perspective view of a pallet according to the present invention positioned on the peak or a roof. In FIG. 1 pallet 1 is shown as straddling the peak or ridge of a roof 2 with opposite sides of the present resting on opposite sides of the roof. For purposes of describing the present invention reference numerals 3 and 4 will be used to identify the sides of the pallet 1 and reference numeral 5 and 6 will be used to identify the ends of the pallet 1. As shown the pallet 1 has a top surface or deck 7 that has a generally rectangular shape. FIG. 1 depicts a load of material, which can represent bundles of shingles 8 on the pallet 1. The deck 7 is supported by a base 9. The base 9 includes a number of legs 10 that extend downward upon which legs 10 the pallet 1 can be supported on a roof 2 as shown in FIG. 1 or on any flat surface such as a truck bed or storage area. The pallet 1 shown in FIG. 1 includes six legs 10, including four corner legs 11 and two middle legs 12 on each side. In other embodiments the pallets of the present invention can have only corner legs, or more than one middle leg on each side. In further embodiments the pallet can include a single leg on either side that extends along the entire length of or a substantial portion of the length of the pallet.

Above the legs 10 the pallet 1 can be provided with structural features that can be used to lift and move the pallet 1. For example the embodiment of the pallet 1 shown in FIG. 1 there are slots 13 provided in the base 9 beneath the deck 7 that can be configured to receive the forks of a fork lift. In other embodiments different structures can be included for receiving lifting straps, hooks, chains, etc., including slots, eye bolts, hooks, pins, etc.

Figure 2:
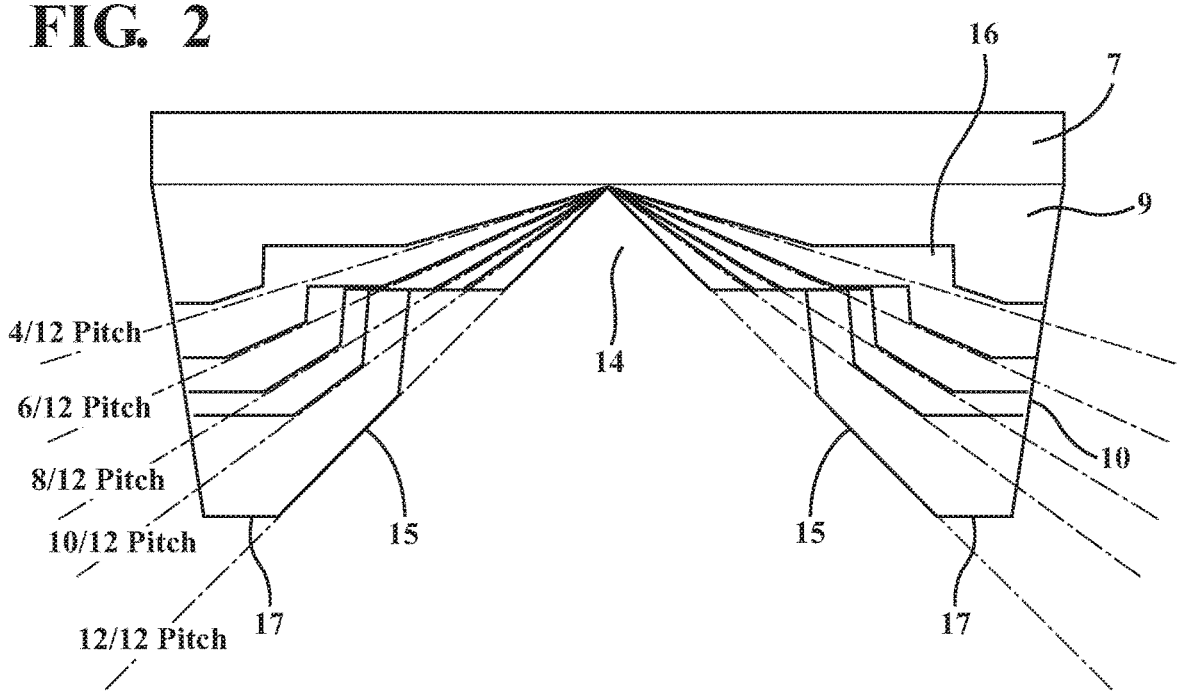
FIG. 2 is an end view that depicts alternative configurations of a pallet according to the present invention for different roof pitches.
Figure 3:
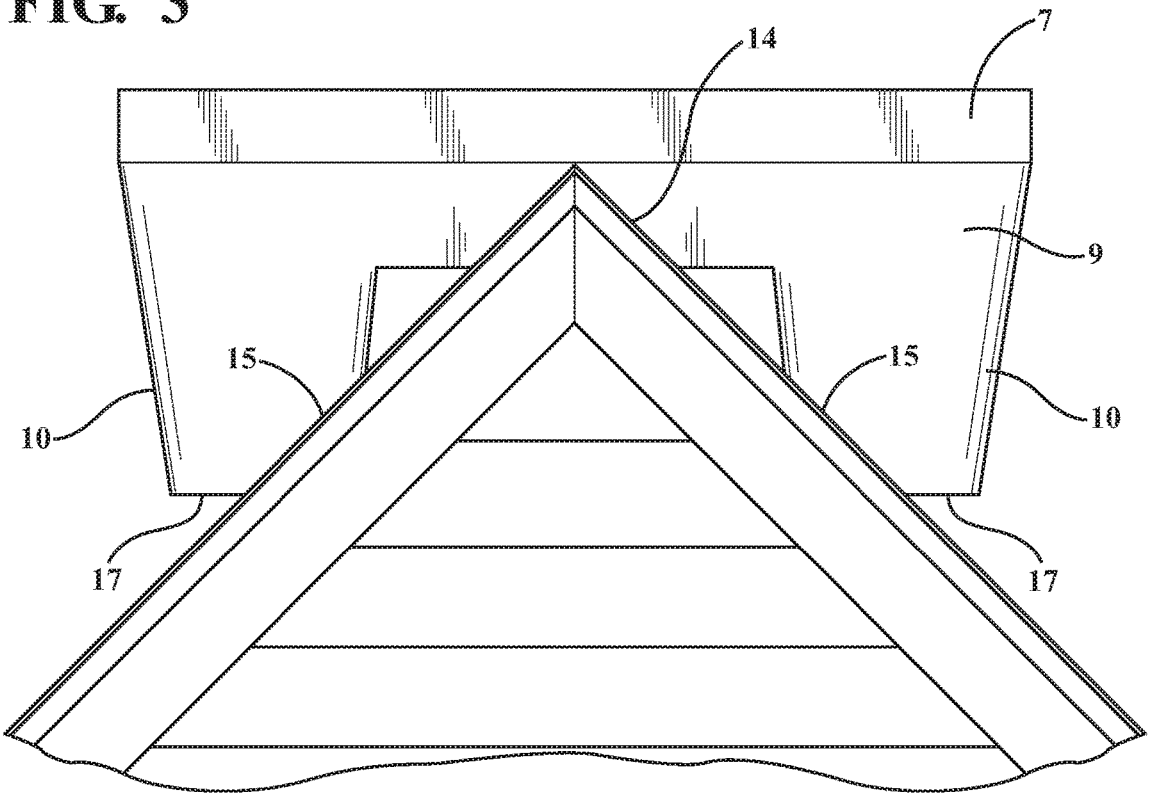
FIG. 3 is an end view of an end view of a pallet according to the present invention positioned on the peak of a roof.

FIG. 2 is an end view that depicts alternative configurations of a pallet according to the present invention for different roof pitches. Roofs have different pitches based on factors that include geographical location, the type of roofing material used, walkability and aesthetics. The pallets of the present invention are configured to be used in conjunction with roofs having different pitches. As shown in FIG. 2 the bottom of the pallets 1 are configured to be complementary to the peak or ridge of roofs to be received thereon. In this regard the center of the bottom of the pallet 1 has an inverted V-shaped recess 14 formed in the base 9 as viewed from either end of the pallet which V-shaped recess 14 extends across the length of the pallet 1. In addition the inner side of each of the legs 10 has an angled surface 15 at the bottom that extends upward toward the center of the bottom of the pallet 1. As shown in FIG. 1 the angle of the angled surfaces 15 of the legs 10 are linearly aligned with the sides of the V-shaped recess 14 for the different roof pitches that are drawn in broken lines in FIG. 2. As shown in FIGS. 2 and 3 the bottom of the pallet 1 can have a recessed area 16 in which the inverted V-shaped recess 14 is formed.

It is also seen in FIG. 2 that the height of the legs 10 vary for roofs having different pitches with shorter legs being provided on pallets that are configured to be used with roofs having smaller pitches. Also as shown in FIG. 2 the width of the recessed area 16 measured between the inside surfaces of the legs 10 in the width direction of the pallets increases as the roof pitch decreases.

Further it is noted that the bottoms of the legs 10 have flat surfaces 17 outward from the angled surfaces 15 which allow the pallets to rest on a flat surface for storage and transportation purposes.

FIG. 3 is an end view of an end view of a pallet according to the present invention positioned on the peak of a roof. As shown in FIG. 3 when the pallets 1 of the present invention are positioned on a roof 2 the peak or ridge of the roof is received in the invented V-shaped recess 14 in the bottom of the pallets 1 and the angled surfaces 15 of the legs 10 rest flatly against the angled sloped surface of the roofs. In this manner the weight of the pallets is distributed between the legs 10 and the bottom center of the pallets and the invented V-shaped recess 14 aligns/centers the position of the pallets and prevents the pallets from shifting sideways.

Figure 4:
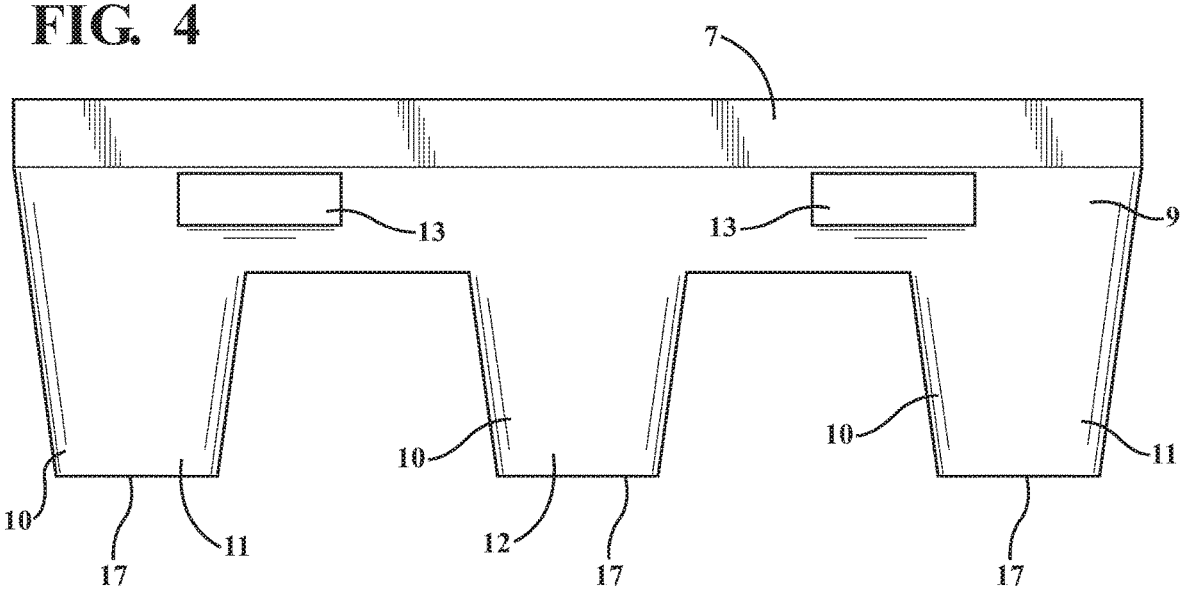
FIG. 4 is a side view of the pallet of FIG. 3.

FIG. 4 is a side view of the pallet of FIG. 3. The pallet 1 shown in FIG. 4 includes corner legs 11 and one middle leg 12. As shown the legs 11 and 12 can be tapered as viewed from the sides of the pallet 1 to reduce the amount of material (and weight) used to make the pallets. Alternatively the legs 11 and 12 could have straight, parallel sides if desired. The legs 11 and 12 can be similarly tapered as viewed from the ends (See FIG. 3) or have straight, parallel sides.

Figure 5:
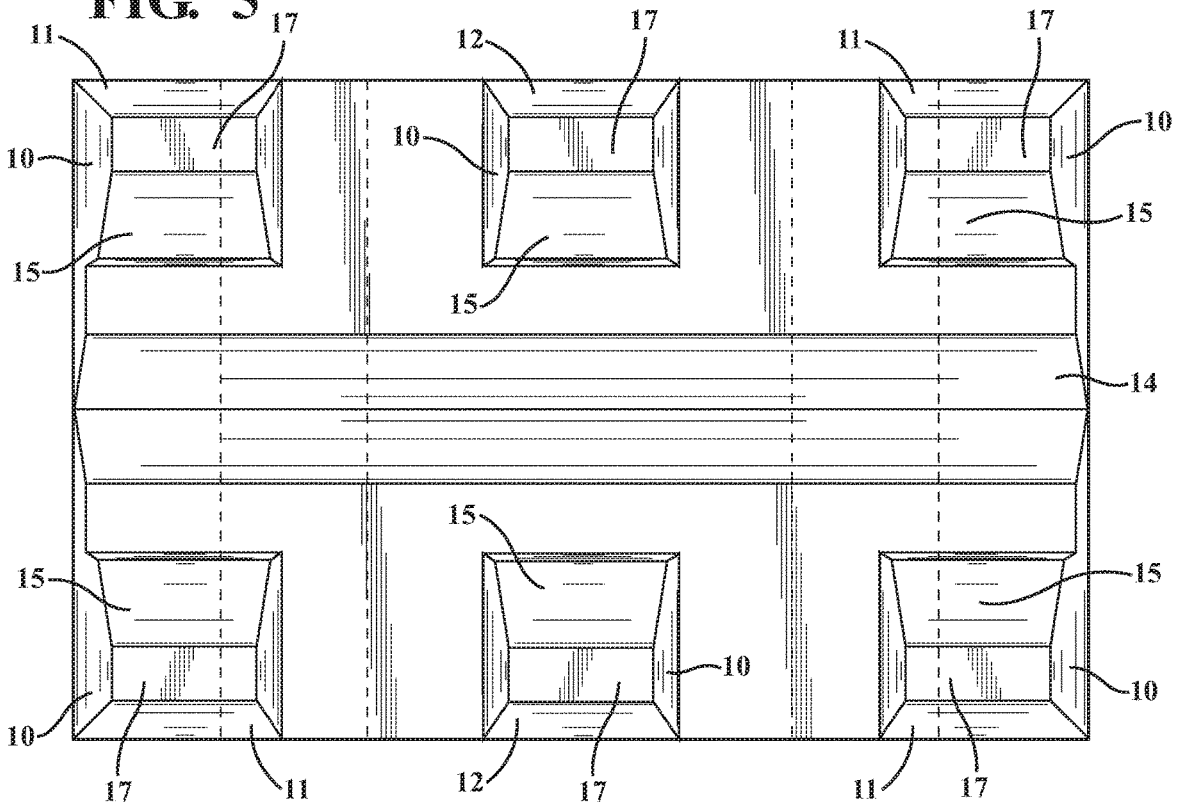
FIG. 5 is a bottom view of the pallet of FIG. 3.

FIG. 5 is a bottom view of the pallet of FIG. 3. In FIG. 5 the V-shaped recess 14 is shown as extending across the length of the pallet 1. The legs 10 are shown as having flat bottoms 17, angled sides 15 and tapered sides as discussed above. The slots 13 that are provided to receive the forks of a fork life are drawn in broken lines in FIG. 5 since these slots are hidden within the pallet 1. As drawn in FIG. 5 the slots 13 extend through the width of the pallet 1. For embodiments of the present invention in which slots 13 are provided that extend completely through the width of the pallet 1 the height of the pallet above the inverted V-shaped recess 14 and below the deck 7 or top surface of the deck 7 can be increased to accommodate the slots 13 so that they can pass over the peak or ridge of the roof when the pallet is positioned on a roof as shown in FIG. 3. Since the use of a fork lift may only be necessary to move the pallets for storage or loading on and off a truck having the forks of a fork life pass through the inverted V-shaped recess 14 will not cause any problems. When such a pallet is lifted by a crane to be position onto a roof in manner that does not obstruct the inverted V-shaped recess having the slots aligned as shown in FIGS. 1 and 4 will not cause any problems.

As shown in FIG. 5 the legs 11 and 12 of the pallet 1 are located within the sides 3, 4 and ends 5, 6 of the deck 7. This configuration will allow empty pallets to be stacked upon one another.

The pallets shown in FIGS. 1-5 have lengths that are greater than the widths of the pallets. In other embodiments the pallets can be configured to have widths that are greater that the lengths of the pallets which might be preferred depending in the space available on a roof.

As mentioned above the pallets can be manufactured as one-piece, molded structures that can be discarded after use or reused. In some embodiments that pallets can be molded from recyclable materials such as plastic materials for purposes of recycling of the materials. In other embodiments the pallets can be molded from materials such as particle board so that they can be discarded and burnt for disposal after use. The use of disposable pallets can eliminate the need of carefully removing the pallets from a roof using a crane or other lifting equipment. Disposable pallets can merely be dropped off a roof without any disassembly and collected with other discarded materials for disposal. In further embodiments the pallets can be molded from structural foam materials which will produce pallets that weight less than those formed as denser solid structures. Techniques for molding structural foam materials from various polymeric materials including thermoset and thermoplastic materials are well known including those that incorporate the use of foaming (or blowing) agents or inert gases during molding processes.

An alternative to a single-piece molded pallet is a pallet that is fabricated from several parts for use as a unitary structure. As an example a unitary pallet could be constructed from a number of wooden parts for use as a unitary structure.

Figure 6:
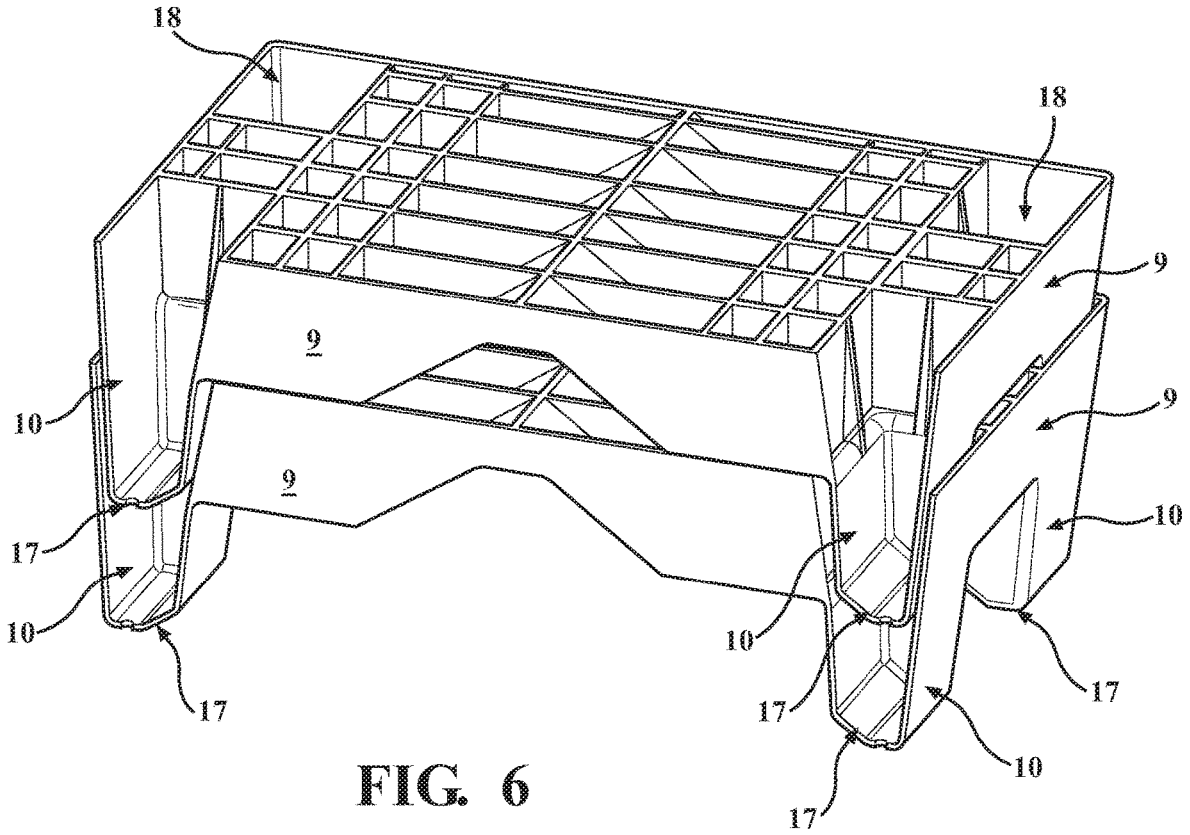
FIG. 6 is a perspective cross-sectional view of nesting pallets according to one embodiment of the present invention.

FIG. 6 is a perspective cross-sectional view of nesting pallets according to one embodiment of the present invention.

Figure 8:
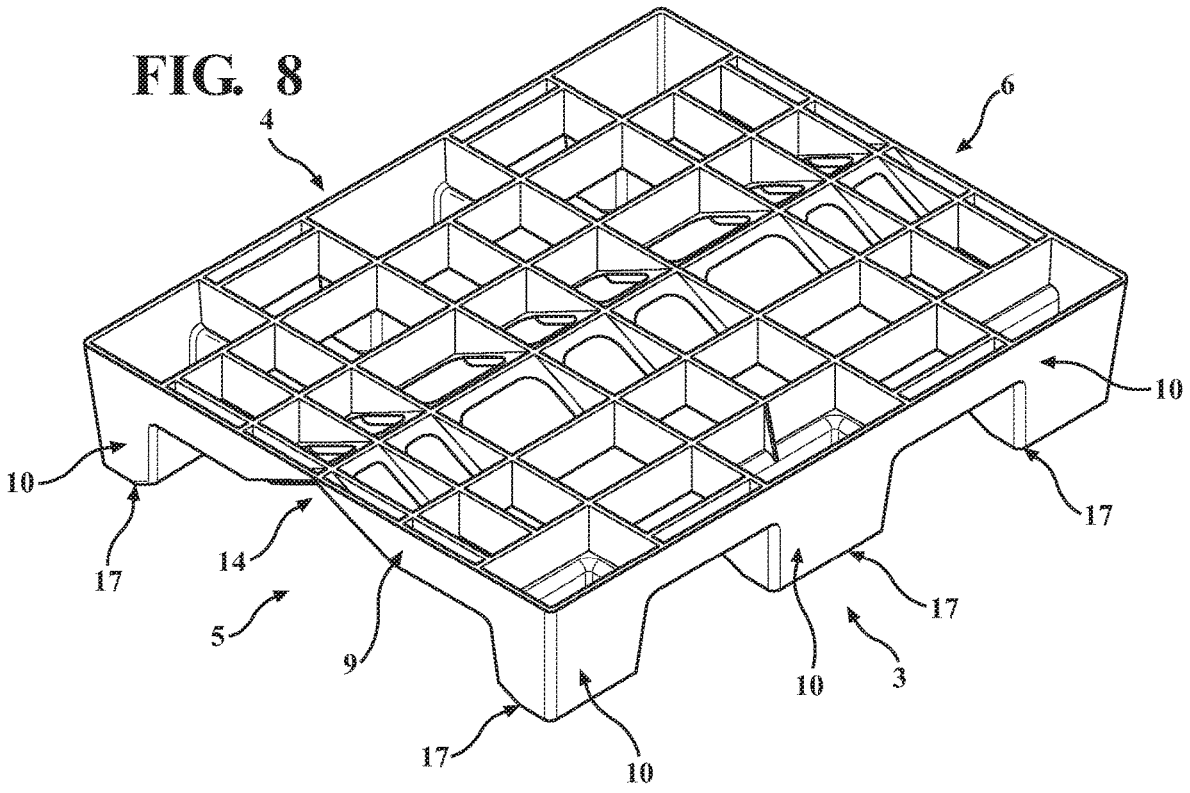
FIG. 8 is a perspective view of a molded pallet according to one embodiment of the present invention.

The pallets shown in FIGS. 6 through 8 are formed with various interconnected rib or web structures as opposed to the sold pallet structures shown in FIGS. 1-5.

A particular unique feature of such pallet designs is the ability to configure the shape of such pallets so that they can nest and be stacked together as shown in FIG. 6. This nesting feature allows for the storing and transportation of empty pallets in a fashion that reduces the space required as opposed to solid structured pallets that may be stacked, but not nested. The configuration of the interconnected rib or web structures further reduces the overall weight as does the use of structural foam materials in the molding of the pallets.

Herein nesting is meant to refer to the ability of at least a portion of one pallet to be received in, or fit in, the structure of another pallet. In the embodiment of the pallets shown in FIG. 6 the legs 10 of the upper pallet is received into the legs 10 of the lower pallet. In this regard the legs 10 have hollow interiors with closed bottoms 17 and open tops 18. Here it is noted that FIG. 6 only illustrates a portion of the pallets which can represent a corner leg 11 and a middle leg 12 similar to the pallets of FIGS. 1, 4 and 5. In other embodiments nesting pallets can be configured with only corner legs similar to the embodiment shown in FIGS. 7*a*-7*d*.

It is also noted that whereas the bottom or base 9 of the top pallet in FIG. 6 rests on the top of the base 9 of the lower pallet, in further embodiments the pallets could be configured so that at least a part or portion of the base of an upper pallet could be received in the base of a lower pallet. Although not shown stop structures can be provided in the nesting structures as desired to limit the depth at which an upper nesting structure is received in a lower, receiving, nesting structure to prevent the nested structure from becoming stuck together or difficult to un-nest. In addition, guiding structures can be provided in receiving nesting structures to guide help guide or align a nesting structure that is received in such receiving nesting structures.

FIGS. 7*a*-7*d* depict views of a two-way pallet that includes inverted V-shaped recesses and angled surface pairs on opposite bottom sides that are configured to allow the pallet to rest on the peaks of roofs that have different slopes.

The embodiment of the pallet exemplified in FIGS. 7*a*-7*d* includes inverted V-shaped recesses and angled surfaces on opposed bottom sides that are at a different angle than the bottom sides of adjacent opposed sides. These different angles can correspond to the different roof pitches illustrated in FIG. 2. In use these "two-way" pallets can be oriented directionally at different 90 degree orientations to rest on the peaks of roofs that have different pitches.

Since in use the pallet 1 shown in FIGS. 7*a*-7*d* are oriented in one of two directions that are aligned at 90 degrees from one another, for descriptive purposes reference will be made to the sides 3 and adjacent sides 3' and not to the ends of the pallets.

The pallet 1 shown in FIGS. 7*a*-7*d* includes two inverted V-shaped recess 14 and 14' that extent between sides 3 and 3' respectively and meet in the center of the pallet. The recesses 14 and 14' and their respective angled surfaces 15 and 15' are preferably formed so as to intersect each other at right angles and have different angular shapes that correspond to different roof pitches. This configuration will allow pallet to be placed on the peak or ridge of a roof having a one pitch, with sides 3 aligned perpendicular to the peak of ridge, or to allow the pallet to be placed on the peak or ridge of a roof having a different pitch, with sides 3' aligned perpendicularly to the peak or ridge.

Other than the two perpendicularly aligned recesses 14 and 14' and the corresponding angled surfaces 15 and 15', the pallet shown in FIGS. 7*a*-7*d* includes a deck 7 and base 9 similar to same elements discussed above in reference to the pallets shown in FIGS. 1-5. Although not shown the pallet of FIGS. 7*a*-7*d* could include a pairs of slots that would between and through sides 3 and 3' to receive the forks of a forklift. In other embodiments different structures can be included for receiving lifting straps, hooks, chains, etc., including slots, eye bolts, hooks, pins, etc.

While the pallet cannot include middle legs that are centered between the illustrated corner legs 11 if such middle legs would preclude the structure of the inverted V-shaped recesses 14 and 14', it is possible for pallets with large bases 9 to include intermediate legs between the corner legs 11 if such intermediate legs do not interfere with the invented V-shaped recesses 14 and 14'.

While the pallet 1 shown in FIGS. 7*a*-7*d* is depicted as being a solid structure similar to that shown in FIGS. 1-5, in further embodiments the two-way pallets of the present invention could be formed (e.g., molded) with various interconnected rib or web structures similar or different to the structures shown in FIG. 6 or 8.

FIG. 8 is a perspective view of a molded pallet according to one embodiment of the present invention.

The pallet of FIG. 8 is formed from a plurality of interconnected rib or web structures as shown. In the embodiment shown in FIG. 8 the sides 3 and 4, and ends 5 and 6 are continuous molded structures that form a unitary rectangular frame with interconnected rib or web structures extending between both opposite sides 3 and 4 and opposite ends 5 and 6 as illustrated to provide mechanical strength to the pallet while reducing overall weight. As shown along the inverted V-shaped recess 14 there are angled frame structures between the adjacent rib or web structures. Also as shown, the legs 10 are hollow and formed integrally with the adjacent sides 3 and 4 and ends 5 and 6. The legs 10 have solid bottoms 17.

The embodiment of the pallet shown in FIG. 8 does not include the deck 7 of FIGS. 1-4. Rather the top of the pallet is open so that the rib or web structures are exposed. In alternative embodiments or in use a flat top or top piece can be provided on or over the top of a portion or then entire top of the pallet shown in FIG. 8.

The embodiments of the pallets that comprise rib or web structures, including those shown in FIGS. 6 and 8 can be molded from structural foam materials or plastics. According to one embodiment pallets such as those shown in FIGS. 6 and 8 can be molded from a structural foam composite material produced when a polymer, usually thermoset (but can be thermoplastic), is combined with either an inert physical gas such as nitrogen, or a chemical blowing agent during the injection molding process. For example the pallets can be injection molded using 100% recycled regrind HDPE, blowing agent, and an optional rubber filler utilizing a structural foam process. While the pitch, height and nesting capability of such pallets can very, in general a pallet wall thickness (thickness of sides, ends and ribs or webs) of about 0.2 inches will provide sufficient mechanical strength.

Non-limiting exemplary specifications for the pallets shown in FIGS. 6 and 8 include a 6/12 pitch pallet that can be 9-6/4" tall, with nesting capability of 6⅝"; a 8/12 pitch pallet that can be 12⅝" tall, with nesting capability of 6⅝"; a 10/12 pitch pallet that can be 15-5/4" tall with nesting capability of 6⅝"; and a 12/12 pitch pallet that can be 18.52" tall with nesting capability of 6⅝."

Although the present invention has been described with reference to particular means, materials and embodiments, from the foregoing description, one skilled in the art can easily ascertain the essential characteristics of the present invention and various changes, and modifications can be made to adapt the various uses and characteristics without departing from the spirit and scope of the present invention as described above and set forth in the attached claims.

The invention claimed is:

1. A pallet that is configured to rest on a peak of a roof and on a flat surface, the pallet comprising:

a top surface for receiving and supporting materials to be delivered to a rooftop;

opposite sides and ends surrounding and extending downward from the top surface;

a plurality of four legs formed integrally with the opposite sides and ends of the pallet with outer surfaces of the plurality of legs being flush with respective outer surfaces of the opposite sides and ends, the plurality of legs having bottom portions that are angled so as to rest on opposite sides of the peak of the roof, and flat bottom portions for resting the pallet on the flat surface; and at least one inverted V-shaped recess formed in a bottom of the pallet which at least one inverted V-shaped recess is configured to rest on the peak of the roof, each of said at least one inverted V-shaped recess is separated from each respective one of the angled bottom portions of the plurality of legs by a horizontal portion and a vertical portion at the opposite ends, wherein the pallet comprises a plurality of interconnected rib or web structures, and frame structures between adjacent ones of the rib or web structure which frame structures define the at least one V-shaped recess.

2. The pallet according to claim 1, wherein the plurality of legs comprises the at least four corner legs located respectively at each corner of the pallet.

3. The pallet according to claim 1, wherein the pallet is a one-piece molded structure.

4. The pallet according to claim 3, wherein the pallet is molded from a structural foam material.

5. The pallet according to claim 3, wherein the pallet is configured to be received by and nest in a portion of another similar pallet.

6. The pallet of claim 5, wherein the legs of the pallet are hollow and configured to be received by and nest in hollow legs of another similar pallet.

7. The pallet according to claim 1 further comprising structural elements for lifting the pallet.

8. A method of delivering objects onto the roof of the building which method comprises:

providing the pallet of claim 1 that comprises:

the top surface for receiving and supporting materials to be delivered to the rooftop;

the opposite sides and ends surrounding and extending downward from the top surface;

the plurality of at least 4 legs formed integrally with the opposite sides and ends of the pallet, with the outer surfaces of the plurality of legs being flush with respective outer surfaces of the opposite sides and ends, the plurality of legs having the angled bottom portions that are angled so as to rest on opposite sides of the peak of the roof; and flat bottom portions for resting the pallet on the flat surface;

the at least one inverted V-shaped recess formed in the bottom of the pallet which the at least one inverted V-shaped recess is configured to rest on the peak of the roof; and the plurality of interconnected rib or web structures, and frame structures between adjacent ones of the rib or web structure which frame structures define the at least one V-shaped recess;

providing a load of objects on the pallet; and lifting the pallet and positioning the pallet onto the roof of the building so that is rests over the peak of the roof to deliver the objects onto the roof.

9. The method of delivering objects onto the roof of the building according to claim 8, wherein the at least one inverted V-shaped recess comprises one inverted V-shaped recess that is extends in a length direction of the pallet.

10. The method of delivering objects onto the roof of a building according to claim 8, wherein the plurality of legs comprises at least four corner legs located in each corner of the pallet.

11. The method of delivering objects onto the roof of the building according to claim 8, wherein the pallet is a one-piece molded structure.

12. The method of delivering objects onto the roof of the building according to claim 8, wherein the pallet is molded from a structural foam material.

13. The method of delivering objects onto the roof of the building according to claim 8, wherein the pallet is configured to be received by and nest in a portion of another similar pallet.

14. The method of delivering objects onto the roof of the building according to claim 13, wherein the legs of the pallet are hollow and configured to be received by and nest in hollow legs of another similar pallet.

15. The method of delivering objects onto the roof of the building according to claim 8, wherein the pallet comprises structural elements for lifting the pallet.

* * * * *